US006138832A

United States Patent [19]

Hunter et al.

[11] Patent Number: 6,138,832

[45] Date of Patent: Oct. 31, 2000

[54] PACKING KIT

[76] Inventors: Michael P. Hunter, 21505 E. Powers Cir. South, Aurora, Colo. 80015; Kevin P. Cross, 6714 S. Ash Way, Littleton, Colo. 80122

[21] Appl. No.: 09/112,721

[22] Filed: Jul. 9, 1998

[51] Int. Cl.[7] ..... B65D 71/00

[52] U.S. Cl. ..... 206/575; 206/577

[58] Field of Search ..... 206/223, 575, 206/576, 577, 232

[56] References Cited

U.S. PATENT DOCUMENTS 4,584,042 4/1986 Wandroik ..... 206/575 X 4,757,901 7/1988 Woods ..... 206/232

5,251,759 10/1993 Gannon et al. ..... 206/575

5,292,003 3/1994 Baghdassarian ..... 206/575

*Primary Examiner*—Jacob K. Ackun

*Attorney, Agent, or Firm*—Lee G. Meyer

[57] ABSTRACT

A kit for packing residential or business goods for relocation includes at least one corrugated packing container, mastic means for securing the containers in its constructive position, wrapping materials for safely securing and placing items within the container, markers and other means for indelibly marking items and instructions for use of the kit.

23 Claims, 2 Drawing Sheets

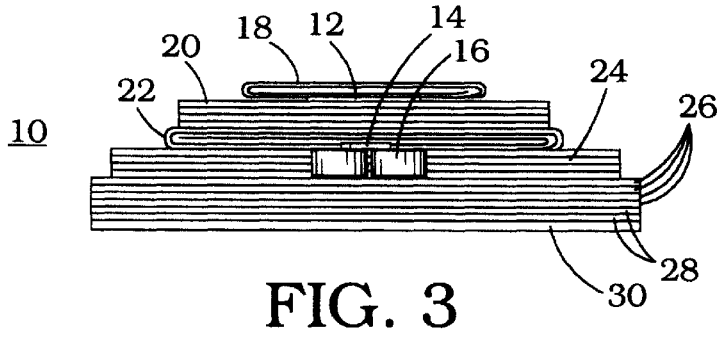
FIG. 3
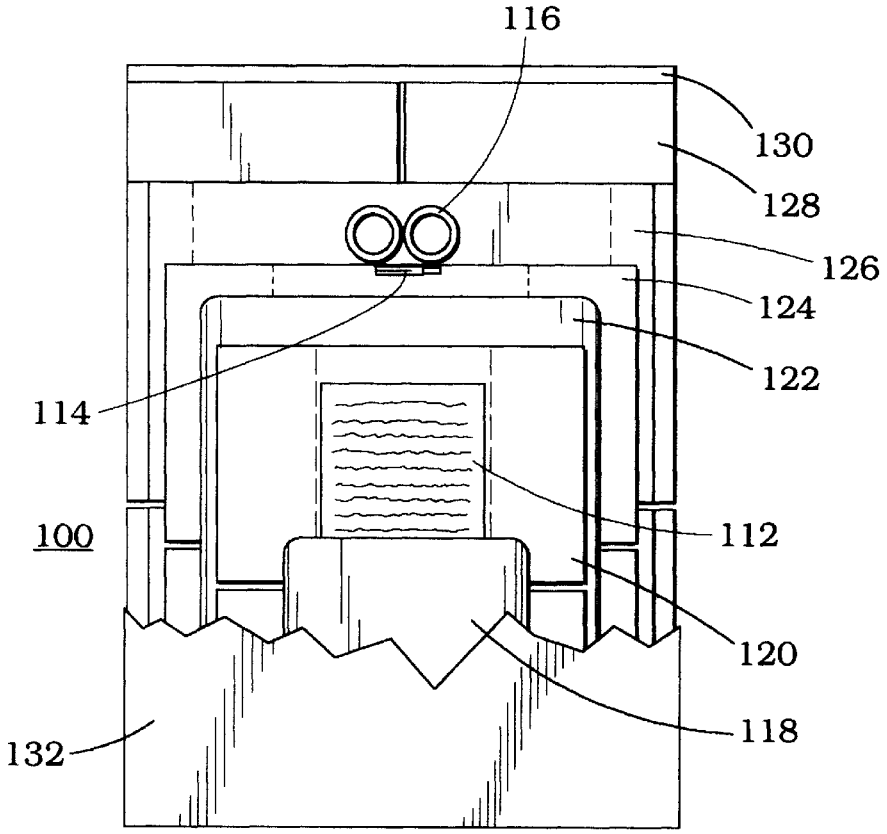
FIG. 4
FIG. 5
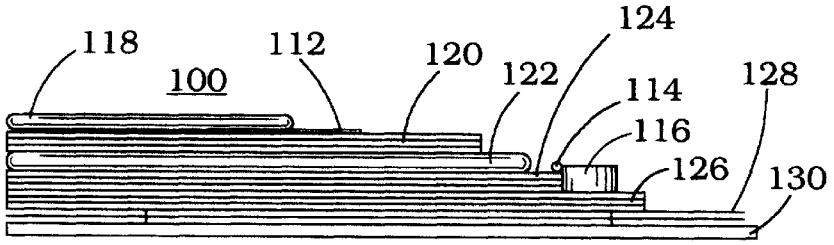

PACKING KIT

BACKGROUND OF THE INVENTION

1. Field of the Invention

This invention relates generally to kits and methods for packing items to be moved by a van or the like; and, more particularly a kit and method for packing personal belongings to be moved by a moving van or the like when relocating businesses or residences.

2. Description of Related Art

America, and in fact the world, has become much more transient. Large companies move personnel from place to place. New jobs open up and new opportunities present themselves which require families and/or businesses to pack their belongings and relocate to a different residence and/or office. Moving of one's personnel effects can be expensive, traumatic, time consuming and generally a negative event in one's life. Because it is not done with enough frequency to gain proficiency, each move takes on the aura of being the very first. In fact it has jokingly been said that the term "good move" is an oxymoron.

When persons, families, residents or even businesses prepare to relocate, one of the most expensive and time consuming aspects of the process is safely packing the goods to be shipped so that they, not only can be unpacked in an orderly manner, but can safely survive the journey arriving with minimum damage. This requires that goods be packed, transported, and unpacked in a manner that assures there integrity throughout the transition.

Many items have traditionally been moved with only moving blankets wrapped therearound or "bubble wrap" placed in strategic places. Things such as china huts, servers, tables, overstuffed chairs and the like, do not lend themselves readily to crating. Although crates exist for such things as appliances and the like, these items are usually moved with minimum of packing, wrapping or crating.

Not so, however, for a number of items ranging from clothes in the closet and mattresses, to kitchen items, utensils, pots, pans, dishes, china, memorabilia and other breakables as well as books, business files, records and the like. All of these loose items need to be packed or crated in order to be effectively and efficiently shipped and unloaded and unpacked with some semblance of order and minimal breakage. In many cases relocating consists of purchasing a number of odd sized crates, cartons and boxes, or getting boxes from various stores. The source of these containers can vary from the corner grocer to warehouses to cartage companies. Thus equipt family members or workers then move randomly from room to room packing their belongings, in an assorted manner. This is done usually without plan, with some boxes being inventoried and marked and some not. Thus the process proceeds more or less randomly, with fragile and staple items being placed together without adequate protection. In many cases the boxes are labeled and in many cases not.

In contrast, when a professional moving or cartage company is hired to professionally pack the items, specific boxes, crates and cartons are used and professional packers who have been trained to wrap and place particular items in particular cartons are sent to the residence or business and effect the packing, sorting, crating and labeling of the goods in an orderly efficient manner.

While this generally results in a much superior move, it is exceedingly expensive and time consuming, in many cases inconvenient, because of the schedule of the packers and movers does not meet the schedule of the party being moved. Thus there exists a necessity for a kit and method which provides all of the appropriate crating, packing, wrapping, adhesive materials and marking implements to effect the packing and relocating of items within a particular room or office along with detailed, professional instructions on utilization of material in the moving kit.

SUMMARY OF THE INVENTION

There is provided in accordance with the instant invention, a packing kit, preferably for a specific room and/or specific items which comprises at least one packing carton; mastic means for appropriately closing and securing the packing carton; wrapping and/or packing material to insulate and maintain positions of items in the packing carton; marking and/or inscribing means to label items in the carton or the carton itself; and, instructions on use of the kit to effect the professional packing of items by use of other elements of the kit.

In accordance with one embodiment, a packing kit for efficiently packing a kitchen comprises an instruction guide, one felt-tip marker, 2 rolls of packing tape, 2 cartons measuring 1.5 cubic feet in volume, 30 lbs. of newsprint, 3 cartons measuring 3.1 cubic feet in volume, 3 cartons measuring 4.5 cubic feet in volume, 5 cartons measuring 5.2 cubic feet in volume. Preferably the contents of the kit are banded or contained in a carrying or storage container.

In another embodiment a kit for efficiently packing a living room includes an instruction guide, one felt-tip marker, 2 rolls of packing tape, 2 paper pads, 4 cartons measuring 1.5 cubic feet in volume, 20 lbs. of newsprint, 5 cartons measuring 3.1 cubic feet in volume, 4 cartons measuring 4.5 cubic feet in volume, 1 cartons measuring 5.2 cubic feet in volume, one two-piece mirror container. The kit is contained in a container.

In another embodiment a kit for efficiently packing a bedroom an instruction guide, one permanent marker, 2 rolls of packing tape, 2 paper pads, 3 cartons measuring 1.5 cubic feet in volume, 20 lbs. of newsprint, 3 cartons measuring 3.1 cubic feet in volume, 3 cartons measuring 4.5 cubic feet in volume, 1 carton measuring 5.2 cubic feet in volume, one two-piece mirror container packaged in a container.

BRIEF DESCRIPTION OF THE DRAWINGS

Other advantages of this invention will be apparent from the following specification, claims, and drawings, in which:

FIG. 3 is an illustrative top view of the general kit as shown in FIG. 2;

FIG. 4 is an illustrative front view of a bedroom kit of the instant invention;

FIG. 5 is a side view of the bedroom kit of FIG. 4.

DETAILED DESCRIPTION OF THE PREFERRED EMBODIMENT

Figure 1:
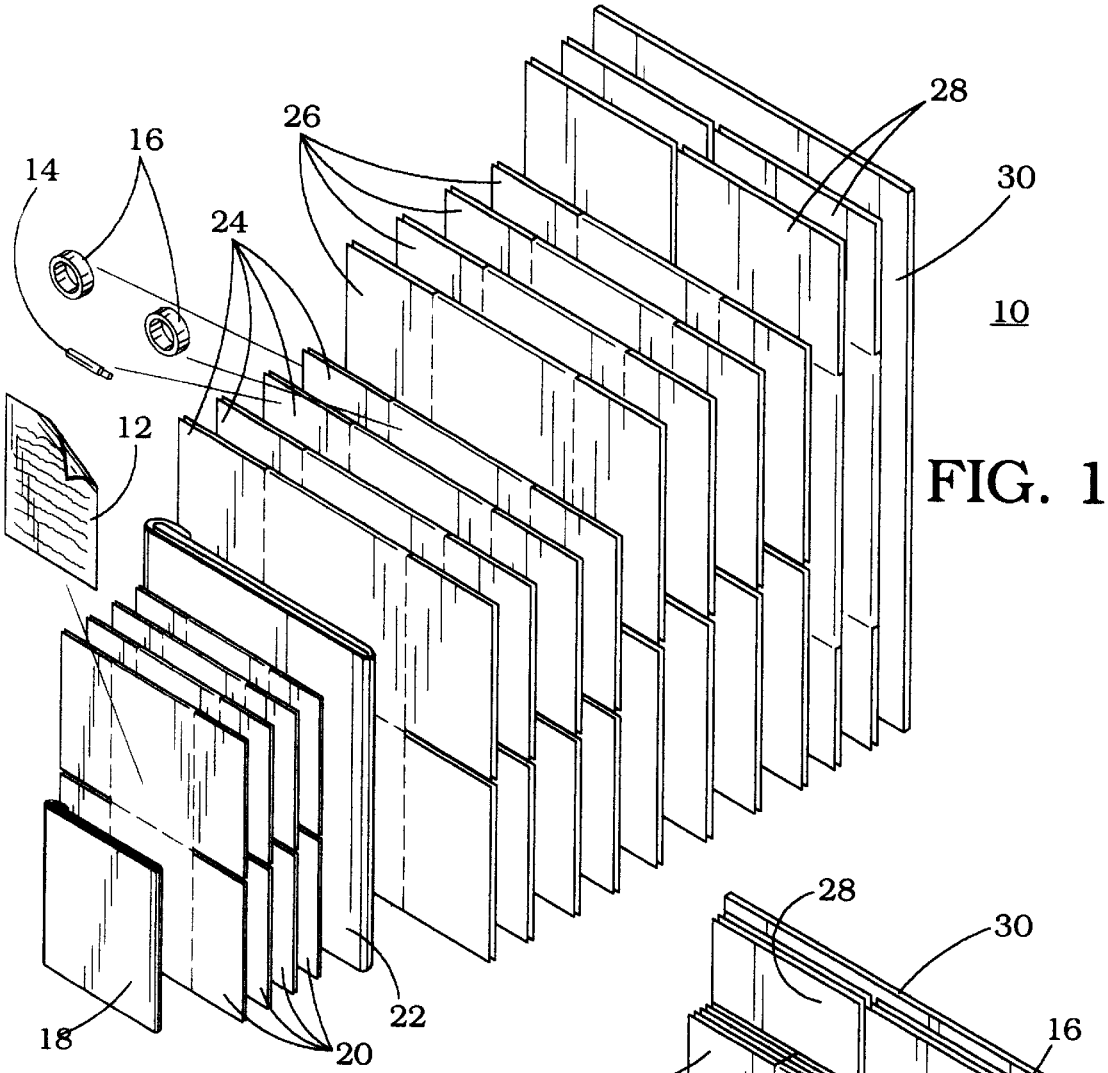
FIG. 1 is an exploded view of the general packing kit in accordance with the invention.

Referring now to the drawings, there is shown in FIG. 1 a general packing kit 10 in accordance with the invention. The kit comprises specific packing instructions 12 for using the packing materials of the remainder of the kit, a number of specific sized packing cartons as set out below, a marker 14, rolls of tape 16, packing paper 18, and packing pads 22.

Figure 2:
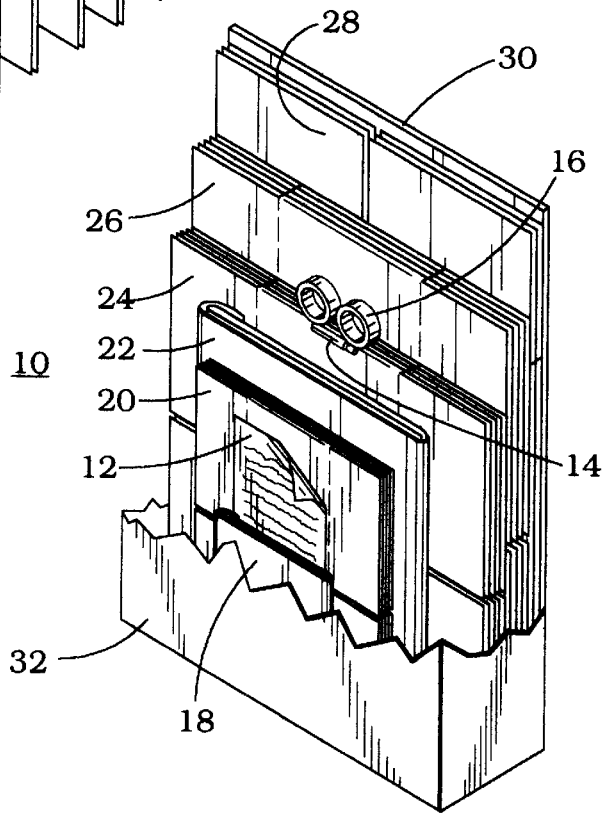
FIG. 2 shows a cutaway perspective view of the general kit of FIG. 1 in a retaining carton.

The correlated packing cartons of general kit 10 comprise four 1.5 cubic foot cartons 20, four 3.1 cubic foot cartons 24, four 4.5 cubic foot cartons 26, two 5.2 cubic foot dish cartons 28 and one two-piece mirror box 30. As seen in FIG. 2 the general kit 10 is itself packaged for marketing, carrying and storage in a container 32.

As shown in FIG. 2 the general kit 10 is packaged within container 32 such that packing instructions 12 are placed proximate paper packing pads 18 and the first of four 1.5 cubic foot cartons 20 which are placed in an upright position in container 32. The packing pads 22 are placed between the last 1.5 cubic foot cartons 20 and the first of the four 3.1 cubic foot cartons 24. Two rolls of tape 26 and a marker 14 rest on the four 3.1 cubic foot cartons 24. Finally, four 4.5 cubic foot cartons 26 are placed next to two 5.2 cubic foot dish cartons 28 which in turn is next to one two-piece mirror box 30 to complete the kit.

Turning to FIG. 3, the general pack 10 and it components as packaged within container 32 is shown in top view. Two paper pads 18 lie atop packing guide 12 which in turn rests atop the first of four 1.5 cubic foot cartons 20. The packing paper 22 rests on the first of four 3.1 cubic foot cartons 24 which in turn rest upon four 4.5 cubic foot cartons 26 and two 5.2 cubic foot dish cartons 28. The two rolls of tape 16 are placed side by side proximate marker 14 atop the four 3.1 cubic foot cartons. The final item is one two-piece mirror box 30.

Turning to FIG. 4, the Bedroom Pack 100. Paper pads 118 are proximate packing guide 112. Three 1.5 cubic foot cartons 120 and packaging paper 122 follow. Three 3.1 cubic foot cartons 124, on which rest two rolls of tape 116 and a marker 114, are proximate three 4.5 cubic foot cartons 126 and in turn one 5.2 cubic foot dish box 128, and finally a two-piece mirror box 130. A packaging container (not shown) envelops the kit 110.

Turning to FIG. 5, the Bedroom Pack 100 shown in FIG. 4 is in side view. On top are two pads of paper 118 under which lies the guide 112 and three 1.5 cubic foot cartons 120. Under this is packaging paper 122 and three 3.1 cubic foot cartons 124 next to which are two rolls of tape 116 and a marker 114. Under that is three 4.5 cubic foot cartons 126, one 5.2 cubic foot dish carton 128 and one two-piece mirror box 130.

The containers that can be used in accordance with the instant invention are any containers known in the art which are adapted for utilization in packing and storing goods and specifically household and business related goods. Examples include corrugated containers, plastic containers, paper containers, cardboard boxes and the like. The preferred container is a cardboard corrugated container which is collapsed and can be constructed using mastic tape or the like. The markers that can be used in accordance with the instant invention are any indelible or other marker, pen, pencil, crayon, felt tip pen or the like. This may also include pre-printed labels or even a label maker. The requisite is for marking and identifying the wrapped goods as well as the containers. The mastic means that can be used in accordance with the instant invention are preferably of the plastic self adhesive tapes, but can be for example, gummed or water moistened tape or possibly even glue. The requisite is that the tape or other adhesive be sufficient to hold the assembled containers in their assembled positions. The packing pads and packing paper, called newsprint can be of any appropriate weight, but newsprint weight is preferred especially for packing crockery, dishes and other fragile items or multiple layers of paper are required to protect particular item. This also could include some form of protective plastic or foam material such as bubble wrap.

The subsequent kits are examples of moving kits that can be assembled in accordance with the instant invention. It will be realized, of course, that the packing instructions will be predicated upon the particular room or grouping of rooms to be moved and the packing instructions are associated with a particular kit. The following kits are examples for illustration only and are not meant to limit the scope of the invention. Additionally, it will be realized that kits can be put together for specific use to pack items in various particular application such as business offices and the like.

GENERAL PACKING KIT

| Contents | Volume | Dimensions-Flat (L × W) | Assembled (L × W × H) |
|---|---|---|---|
| 1 Packing Guide | N/A | N/A | N/A |
| 1 Marker | | | |
| 2 Tape Rolls | | | |
| 2 Paper Pads | | | |
| 4 Small Cartons | 1.5 cubic feet | 26" × 29" | 16" × 12½" × 12½" |
| 20 lbs. Packing Paper | | | |
| 4 Medium Cartons | 3.1 cubic feet | 35" × 36" | 18" × 18" × 16" |
| 4 Large Cartons | 4.5 cubic feet | 36½" × 42½" | 24" × 18" × 18" |
| 2 Dish Carton | 5.2 cubic feet | 47" × 36½" | 18" × 18" × 28" |
| 1 Mirror Box (2 pcs.) | | | |
| Package Container | | | |

BEDROOM PACKING KIT

| Contents | Volume | Dimensions-Flat (L × W) | Assembled (L × W × H) |
|---|---|---|---|
| 1 Packing Guide | N/A | N/A | N/A |
| 1 Packing Guide | N/A | N/A | N/A |
| 1 Marker | | | |
| 2 Tape Rolls | | | |

-continued

| Contents | Volume | Dimensions-Flat (L × W) | Assembled (L × W × H) |
|---|---|---|---|
| 2 Paper Pads | | | |
| 3 Small Cartons | 1.5 cubic feet | 26" × 29" | 16" × 12½" × 12½" |
| 10 lbs. Packing Paper | | | |
| 3 Medium Cartons | 3.1 cubic feet | 35" × 36" | 18" × 18" × 16" |
| 3 Large Cartons | 4.5 cubic feet | 36½" × 42½" | 24" × 18" × 18" |
| 1 Dish Carton | 5.2 cubic feet | 47" × 36½" | 18" × 18" × 28" |
| 1 Mirror Box (2 pcs.) | | | |
| Package Container | | | |

KITCHEN PACKING KIT

| Contents | Volume | Dimensions-Flat (L × W) | Assembled (L × W × H) |
|---|---|---|---|
| 1 Packing Guide | N/A | N/A | N/A |
| 1 Marker | | | |
| 2 Tape Rolls | | | |
| 2 Small Cartons | 1.5 cubic feet | 26" × 29" | 16" × 12½" × 12½" |
| 30 lbs. Packing Paper | | | |
| 3 Medium Cartons | 3.1 cubic feet | 35" × 36" | 18" × 18" × 16" |
| 3 Large Cartons | 4.5 cubic feet | 36½" × 42½" | 24" × 18" × 18" |
| 5 Dish Cartons | 5.2 cubic feet | 47" × 36½" | 18" × 18" × 28" |
| Package Container | | | |

LIVING ROOM PACKING KIT

| Contents | Volume | Dimensions-Flat (L × W) | Assembled (L × W × H) |
|---|---|---|---|
| 1 Packing Guide | N/A | N/A | N/A |
| 1 Marker | | | |
| 2 Tape Rolls | | | |
| 2 Paper Pads | | | |
| 4 Small Cartons | 1.5 cubic feet | 26" × 29" | 16" × 12½" × 12½" |
| 20 lbs. Packing Paper | | | |
| 5 Medium Cartons | 3.1 cubic feet | 35" × 36" | 18" × 18" × 16" |
| 4 Large Cartons | 4.5 cubic feet | 36½" × 42½" | 24" × 18" × 18" |
| 1 Dish Carton | 5.2 cubic feet | 47" × 36½" | 18" × 18" × 28" |
| 1 Mirror Box (2 pcs.) | | | |
| Package Container | | | |

What is claimed is:

1. A packing kit adapted for use in packing items for moving transport, comprising in combination:

a. at least one packing carton for packing items;

b. mastic means for appropriately closing and securing said carton;

c. packing material to maintain positions of items in said carton;

d. inscribing means to label said items in the carton or said carton;

e. instructions on use of contents of said packing kit to effect the professional packing of items by use of other elements of the kit.

2. The packing kit of claim 1 wherein said packing carton is selected from the group of corrugated cardboard, paper, or plastic.

3. The packing kit of claim 1 wherein said mastic means is selected from the group consisting of self adhesive tapes, gummed or water moistened tape, or glue.

4. The packing kit of claim 1 wherein said packing material is selected from the group consisting of paper pads, newsprint, and plastic cushioning.

5. The packing kit of claim 1 wherein said inscribing means is selected from the group consisting of indelible markers, pens, pencils, crayons, pre-printed labels or label makers.

6. The packing kit of claim 1 wherein said at least one packing carton is selected from the group consisting of at least one carton measuring 1.5 cubic feet in volume, at least one carton measuring 3.1 cubic feet in volume, at least one carton measuring 4.5 cubic feet in volume, at least one cartons measuring 5.2 cubic feet in volume, at least one two-piece mirror container.

7. The packing kit of claim 1 wherein said packaging for the kit is packaged by banding or other container.

8. A general packing kit adapted for use in packing items for moving transport, comprising in combination:

an instruction guide, at least one inscribing means, at least 2 units of mastic means, at least 2 paper pads, at least 4 cartons measuring 1.5 cubic feet in volume, at least 20 lbs. of newsprint, at least 4 cartons measuring 3.1 cubic feet in volume, at least 4 cartons measuring 4.5 cubic feet in volume, at least 2 cartons measuring 5.2 cubic feet in volume, at least one two-piece mirror container and at least one package container.

9. The packing kit of claim 8 wherein said packing cartons are comprised of corrugated cardboard, paper or plastic.

10. The packing kit of claim 8 wherein said mastic means is selected from the group consisting of self adhesive tapes, gummed or water moistened tape, or glue.

11. The packing kit of claim 8 wherein said inscribing means is selected from the group consisting of indelible or other marker, pen, pencil, crayon, felt tip pen, pre-printed labels, or label maker.

12. A packing kit adapted for use in packing bedroom items for moving transport comprising:

at least one instruction guide, at least one inscribing means, at least 2 mastic means, at least 2 paper pads, at least 3 cartons measuring 1.5 cubic feet in volume, at least 20 lbs. of newsprint, at least 3 cartons measuring at least 3.1 cubic feet in volume, at least 3 cartons measuring 4.5 cubic feet in volume, at least 1 carton measuring 5.2 cubic feet in volume, at least one two-piece mirror container and at least one package container.

13. The packing kit of claim 12 wherein said packing cartons are comprised of corrugated cardboard, paper or plastic.

14. The packing kit of claim 12 wherein said mastic means is selected from the group consisting of self adhesive tapes, gummed or water moistened tape, or glue.

15. The packing kit of claim 12 wherein said inscribing means is selected from the group consisting of indelible or other marker, pen pencil, crayon felt tip pen, pre-printed labels, or label maker.

16. A packing kit adapted for use in packing kitchen items for moving transport comprising:

at least one instruction guide, at least one inscribing means, at least 2 units of mastic means, at least 2 cartons measuring 1.5 cubic feet in volume, at least 30 lbs. of newsprint, at least 3 cartons measuring 3.1 cubic feet in volume, at least 3 cartons measuring 4.5 cubic feet in volume, at least 5 cartons measuring 5.2 cubic feet in volume and at least one package container.

17. The packing kit of claim 16 wherein said packing cartons are comprised of corrugated cardboard, paper or plastic.

18. The packing kit of claim 16 wherein said mastic means is selected from the group consisting of self adhesive tapes, gummed or water moistened tape, or glue.

19. The packing kit of claim 16 wherein said inscribing means is selected from the group consisting of indelible or other marker, pen pencil, crayon felt tip pen, pre-printed labels or label maker.

20. A packing kit adapted for use in packing living room items for moving transport comprising: at least one instruction guide, at least one inscribing means, at least 2 rolls of mastic means, at least 2 paper pads, at least 4 cartons measuring 1.5 cubic feet in volume, at least 20 lbs. of newsprint, at least 5 cartons measuring 3.1 cubic feet in volume, at least 4 cartons measuring 4.5 cubic feet in volume, at least one carton measuring 5.2 cubic feet in volume, at least one two-piece mirror container and at least one package container.

21. The packing kit of claim 20 wherein said packing cartons are comprised of corrugated cardboard, paper or plastic.

22. The packing kit of claim 20 wherein said mastic means is selected from the group consisting of self adhesive tapes, gummed or water moistened tape, or glue.

23. The packing kit of claim 20 wherein said inscribing means is selected from the group consisting of indelible or other marker, pen, pencil, crayon, felt tip pen, pre-printed labels or label maker.

* * * * *